United States Patent [19]

Greenbaum

[11] Patent Number: 5,065,890

[45] Date of Patent: Nov. 19, 1991

[54] COMPLY SYSTEM

[76] Inventor: George Greenbaum, 1005 N. Caribe Ave., Tucson, Ariz. 85710

[21] Appl. No.: 636,622

[22] Filed: Jan. 2, 1991

Related U.S. Application Data

[63] Continuation-in-part of Ser. No. 559,311, Jul. 30, 1990, Pat. No. 5,022,555.

[51] Int. Cl.[5] ..... B65D 7/00

[52] U.S. Cl. ..... 220/401; 220/461; 220/608; 220/651

[58] Field of Search ..... 220/461, 466, 401, 668, 220/643, 644, 645, 651, 656, 653

[56] References Cited

U.S. PATENT DOCUMENTS

| | | | |
|---|---|---|---|
| 2,904,210 | 9/1959 | Grossman | 220/401 |
| 4,714,353 | 12/1987 | Leaphart | 220/401 |
| 4,823,972 | 4/1989 | Ressler et al. | 220/668 |
| 4,901,959 | 2/1990 | Stage | 220/401 |
| 4,905,822 | 3/1990 | Bosco | 220/668 |
| 4,947,988 | 8/1990 | Schutz | 220/401 |

*Primary Examiner*—Joseph Man-Fu Moy

*Attorney, Agent, or Firm*—Samuels, Gauthier & Stevens

[57] ABSTRACT

A container includes a liner having longitudinal members compressively secured together by a first carrier film, at least one water-impermeable barrier film overlying the liner, a second carrier film overlying the barrier film to form a container; and some of the longitudinal members comprising specially extruded members, the specially extruded members comprising first and second members, one received within the other for the entire length thereof, the members joined together to function as an integral unit.

17 Claims, 4 Drawing Sheets

COMPLY SYSTEM

CROSS REFERENCE TO RELATED APPLICATIONS

This application is a continuation-in-part application of U.S. Ser. No. 559,311 filed 30 July 1990, now U.S. Pat. No. 5,022,555 issued June 11, 1991.

BACKGROUND AND SUMMARY OF THE INVENTION

The present invention relates to a low cost system for the fabrication of storage containers, the containers so formed and the structural elements used to form containers.

Storage containers or vessels are usually fabricated from cast materials whether metal or plastic or they may be flexible containers with or without reinforcing. The following prior art is believed relevant to the present disclosure. U.S. Pat. Nos. 3,657,042; 4,277,688; 3,875,723; 4,353,763; 4,132,050; 4,409,776; 2,260,064; and 4,451,739; and European Patent 0072429.

There is a need for a vessel, container, tank or related structure that has low cost, ease of on site fabrication and particularly, a highly sophisticated custom tailored construction to match demanding specifications.

Broadly, the invention is directed to structural improvements of the container disclosed in my parent application, which application is incorporated by reference in its entirety into this disclosure.

With larger structures the compression caused by the carrier films and then subsequently by the hydraulic pressure of the water when the container is filled requires that a structure of a different design be used.

In one design, a first grid of pipe and fittings is formed. A second companion or identical grid of pipes and fittings is formed and pressure absorption blocks are disposed between the first and second grids to form a sandwich-like assembly. This sandwich-like assembly is then individually wrapped with the plastic carrier film and the wrapped assemblies subsequently joined to one another to form the bottom, sides and top of the frame. This frame is then wrapped, as is the frame of the preferred embodiment to form a 'liner' as described in my parent application or a container per se.

In another design, alone or in combination with the one deisgn, specially formed pipe is used. The pipe can comprise an extruded pipe which may be round, rectangular or any desired shape, but obviously from a point of view of manufacturing, either round or rectangular is preferred. Received within the pipe is an extruded profile which can be in any geometric configuration as long as it functions in combination with the pipe to provide a pipe of increased strength. Typical extruded profiles could includes spokes, a maltese cross, an I-beam and the like. The extruded profiles can also be of the same cross sectional shape as the pipe and telescoped therein. The extruded profile can have a thin coating of an adhesive on its surface to ensure engagement with the pipe. The adhesion can be a mechanical adhesion or a chemical adhesion, such as cross-linking by polymerization. One can pick from a variety of thermoplastic/thermosetting resins to effect the bond. The pipe and extruded profile are customized to create the strongest possible fusion between the two or three concentric or telescoped elements.

Where similar pipes are used in the telescoped arrangement, the outer surface of the inner pipe can be ribbed, either in corrugated form or spirally, to enhance the bonding between the inner and outer pipes. The bonding interface can also have polymerizable resins. These can contain such reinforcing dispersions as small metallic, needle-like particles, such as iron or copper fillings or short fiberglass or carbon fiber filaments. When fully polymerized, their random orientation, embedded in the polymer matrix, will impart to the laminated extrusion greater compression and tensile strength. The polymerization can take place at room temperature or the polymerization can be accelerated by passing the assembled components into a heat exchange zone, such as by the use of microwave or high-frequency radiation.

In another preferred embodiment, the container is used as an anaerobic digester. The container is filled with the material to be digested. Concentric pipes are received in the container to introduce nutrients, fluids and other additives into the digester and the liquid and methane formed in the digester is removed.

In another embodiment of the invention, a panel is uniquely adapted for use in a greenhouse-like structure. A single or double pipe frame may simply be wrapped with clear stretch film. Water or other heat exchange fluids can flow through the pipe and/or into a chamber within the panel. The panels may be assembled such that water or other heat exchange fluids, including as gases, be transferred from one panel to another.

DESCRIPTION OF THE PREFERRED EMBODIMENT(S)

BASIC CONTAINER

The basic container comprises a liner, a barrier film overlying the liner and a carrier film to secure the liner in place. The liner comprises a frame and carrier film. Reinforcing members are secured to the shell and overwrapped with carrier film to form the container.

When the frame is assembled, continuous longitudinal plastic pipes, such as pvc pipes, are joined one to the other with standard fittings. To enhance the strength of the structure, cement may be poured into the open pipe. This would include a cement mixture with granules to give it greater resiliency or a precatalyzed polymerizable liquid base material which hardens into a tough solid mass.

Figure 1:
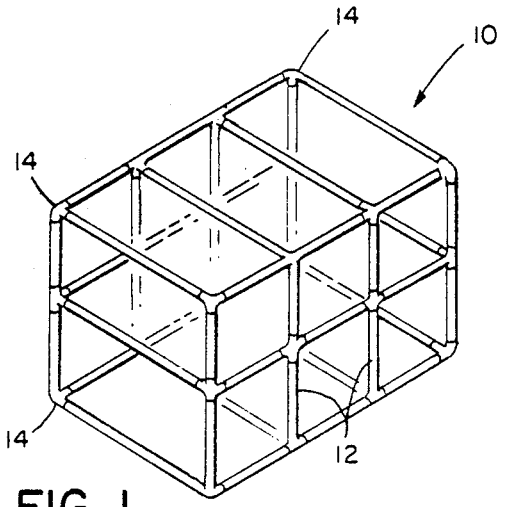
FIG. 1 is a perspective view of a frame.

Referring to FIG. 1, a generally rectangular frame 10 is shown and comprises pipes 12, such as PVC pipes, joined together with standard fittings 14 such as tees, 90° and 45° elbows, three and four-way fittings, etc. where necessary.

The pipes and fittings are loosely assembled and no adhesives are used and threads and compression fits are not required.

Figure 2:
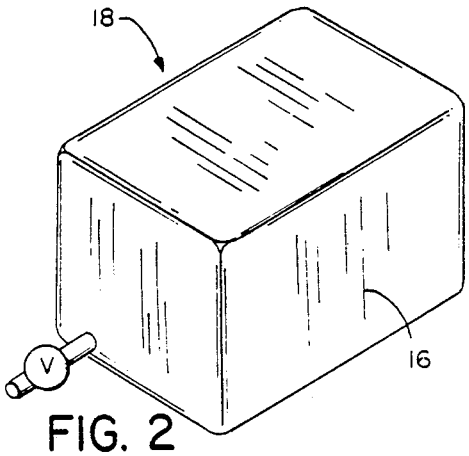
FIG. 2 is a perspective view of the frame of FIG. 1 with a first wrapping of carrier film to form a liner.

Referring to FIG. 2, the frame is wrapped (first wrapping) with carrier film material 16 to form a liner 18. The frame is wrapped with four or more plies of stretch wrap under tension. The carrier film compresses the frame to form a very tight structure. The pressure the film creates, wound under tension, forces all the elements of the frame (pipe and fittings) to be literally squeezed together in a strong and sturdy configuration. Thus, the frame can be assembled with the fittings but without the necessity of using adhesives which are generally toxic.

Figure 3:
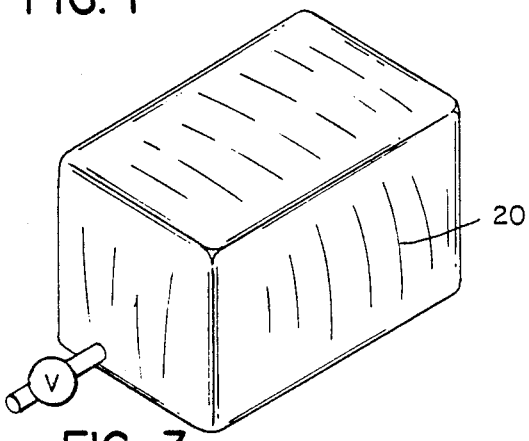
FIG. 3 is a perspective view of FIG. 2 with a wrapping of impervious barrier film.

Referring to FIG. 3, a barrier film 20 is then wrapped about the liner 18. This barrier film 20 is preferably a laminated polyolefin or polyvinyl and initially is held in place by the use of any suitable cement or the like. This barrier film ensures that if there are leaks in the stretch wrap that the water will not leak from the finally assembled container. Preferably, the barrier film is 2 to 4 mil polyethylene and/or PVC film of at least two layers laminated to itself, such as by adhesives. It is also possible that the carrier film can function as a barrier film by coating the carrier film with suitable adhesives and/or polymerizable resins.

Figure 4:
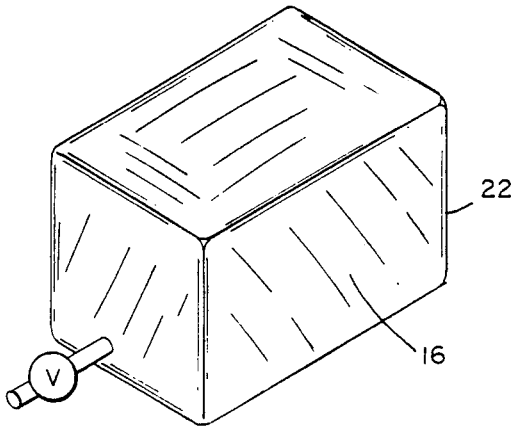
FIG. 4 is a perspective view of FIG. 3 with an additional wrapping of carrier film to secure the barrier film and to form a shell.

Referring to FIG. 4, a second wrapping of carrier film 16 is applied over the barrier film to form a shell 22. If desired, this second wrapping of carrier film can comprise a mesh-like film which is then coated with cement or similar material to provide increased rigidity to the final structure.

Figure 5:
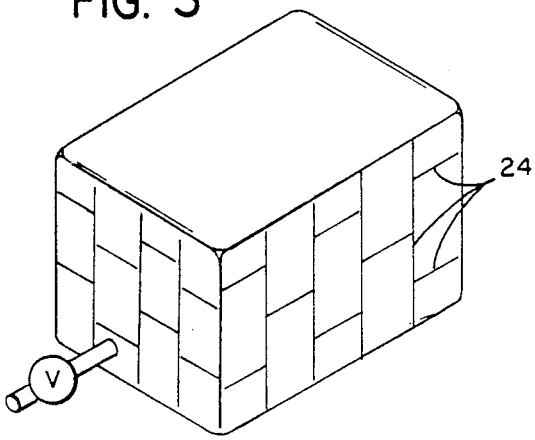
FIG. 5 is a perspective view of the shell of FIG. 4 with additional reinforcing members.

Typically, if the shell 22 were filled with water, it would tend to bulge because of the pressure. Referring to FIG. 5, the shell 22 of FIG. 4 has reinforcing members 24, PVC pipes and fittings, secured against the outer surface of the shell.

Figure 6:
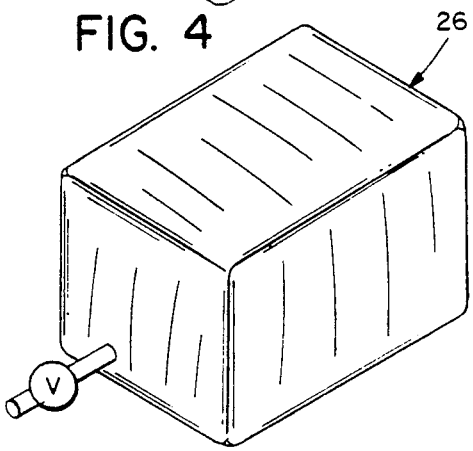
FIG. 6 is a perspective view of FIG. 5 with carrier film securing the additional members to form a container.

Referring to FIG. 6, additional carrier film 16 is wrapped around the reinforcing members 22 to compressively secure them against the shell wall to form a container 26. This combination of reinforcing members and additional film 16 also functions to insulate the water stored in the container.

In the following disclosure, reference is made to heavy duty panels and special structural extrusions. It is to be understood that for the container described for FIGS. 1-6 and for the containers described hereinafter for water disinfection and purification, digestion, greenhouse and the like, that the heavy duty panels may be used for the floor, walls and/or top or any combination thereof and/or the special structural pipe may be used for the floors, walls, bottom, top, frame members, reinforcing members and any combination thereof, and may be used in combination with to form all or part of a heavy duty panel.

CARRIER-BARRIER FILMS

The actual technique of wrapping is not a part of the invention. Any wrapping techniques including spiral wrapping techniques known to those skilled in the art for wrapping rectangular, semi-circular, circular containers and the like with a plurality of films, webs, ribbons and the like may be used. One of the factors considered in selecting the films of the container disclosed herein, and particularly for the liner film, is to use resins which will not effect the taste of the stored water.

In wrapping the frame 10, a film, such as 2 mil high molecular weight crosslinked polyethylene or 1½ mil high density, high molecular weight polyethylene film, is wrapped about the structure 10. When it is desired to interleave a barrier film, it is wrapped around the carrier film 10. The width of the barrier film is generally co-extensive with the lateral edges of the carrier film and long enough such that it completes one and one half revolutions about the structure 10.

Depending upon the size of the container, the number of layers of barrier film will vary. For example, it may be feasible to make 20 wraps or revolutions of carrier film, followed by two or three or more revolutions of barrier film followed by 10 or 20 wraps of carrier film which again may be followed by wraps of the same or distinct barrier films followed by a final wrap or wraps of carrier film.

When the frame 10 is wrapped to the desired degree, the carrier film is severed and the trailing edge of the carrier film is fused or adhered, such as with epoxy adhesives, to form a wall seal.

Preferably, stretch film is wound around the outside surface of the frame with a variable number of layers which will be determined by the ultimate size of the container. The larger vessel is, the more material it will hold and therefore greater wall strength will be required. That is, the greater the weight, the greater will be the thickness of the film wall. The stretch films slightly tacky surface will make a soft, strong and resilient barrier. Thus, the wrapping may be left intact as such and become the finished container.

In the preferred embodiment, then, there are three overwrappings of carrier film; a first wrapping to form the liner; a second wrapping to secure the barrier film in place; and a third wrapping to secure the reinforcing members in place. For the first wrapping and/or barrier film, the films are preferably treated or have incorporated therein a leachable anti-microbial agent to disinfect the stored water. When the second and third plies of carrier film are being applied, except for the liner, a high tack adhesive or polymerizable epoxy may be sprayed to enhance bonding. For the second and third wrappings, barrier films may be used to enhance the properties of the container.

Preferred barrier films include but are not limited to polycarbonates, polyvinyl, alcohols, polybutylenes, polyvinylidenes chlorides, polyvinylchlorides, polystyrenes, halogenated fluoropolyethylenes (Tedlar of du Pont), resin and polymer saturated papers.

The barrier film preferably has a melt index which is compatible with the carrier film. If the layers of carrier film adjacent the barrier film are fused, then the barrier film should be selected to adhere to the carrier film without losing its chemical and physical properties. Such combinations are readily determinable by one skilled in the art.

Adhesives, high or low viscosity, may be used per se as a barrier film. The adhesives may have incorporated therein pesticides to prevent contamination of the contents of the container. Abrasive material, such as sand, glass frit or fiberglass, may be used with the adhesive layer and/or with the pesticides to prevent or discourage pests including mice and rodents from penetrating the container.

The adhesives, when used, may range from minimal ones that simply act as "tackifiers" to hold in place several inner layers to high tack adhesives and/or very viscous adhesives to prevent dislodgement of adhered layers. Gas impermeable membranes may be made of laminated films; nylon fabrics that impart great resistance to punture/penetration; radiation reflecting surfaces such as metallized films all may be used either alone or in combination.

In addition, should particularly strong chemical resistance be needed for protection from the outside, spraying or coating so-called prepolymers (polymers that have not yet been fully polymerized), which in presence of ultra-violet or other exposure, are transformed in situ among the layers into a super tough, ultra-strong and chemically resilient barrier.

The number of stretch film layers in this applications can be varied to withstand any resulting internal pressure.

This carrier film is fusible at low temperatures or by the application of adhesives. Only the outer layers may be fused or adhered or all layers may be fused into one integral piece.

The preferred embodiment has been described wherein the carrier film is high density, high molecular weight polyethylene. An equally preferred embodiment is where the carrier film is polyethylene or PVC stretch wrap.

This carrier film is cohesive and at ordinary room temperatures and under tension allows two adjacent film surfaces to cling/adhere together to form an integral piece.

If the carrier film does not inherently cling/adhere when a sleeve is formed, the trailing edge of the film is adhered to the next inner layer by the application of heat, adhesives or polymerizable resins. The application of heat enhances the adhesive characteristics of the film, but the film does not fuse and become a single mass. Then ends of the sleeve are formed are sealed by tying the same. They cannot be fused at low temperatures. The preferred method of tying is the 'tipper tie' which is placing a metal band about the ends and crimping the same. This tie is used in the meat packing and will hold a vacuum. Thus, tying the ends with this technique will encapsulate the wastes in a fluid impermeable container.

CONTAINER USES

Disinfection

Although the container has been disclosed as a single unit, it is within the scope of the invention that the container can function as a module and be joined to like containers with suitable fittings to allow for the flow of water between the containers when they function as modules. Two containers can be joined end to end and wrapped with carrier film having the necessary adhesive characteristics, including having adhesive coatings thereon to join the containers one to the other.

To aid in the disinfection of the water, a coil of copper or silver can be placed in the tank and has an electromotive force applied thereto. This will aid in the disinfection of the water.

Additionally, other additives, such as sodium or stannous chloride, may be added for tooth protection. Further, treated or untreated bentonite clay with silver compounds, such as colloidal silver or silver salts, can be used. Lastly, solids that generate oxygen when immersed in water, such as sodium perborate and similar compounds, can be used.

Purification

Three stacked containers which are in fluid flow communication with one another function as follows from the uppermost container; a first flocculation zone, the next lower succeeding container functioning as a sedimentation zone, the next second lower succeeding container functioning as a purification/filtration zone and can contain sand/gravel to function as a filtering medium, and the third bottom container functioning as a storage container in accordance with the invention and including the disinfecting features. Obviously the three containers solely for purification may be used alone or in combination with a container for disinfection.

Storage containers of the invention may also be used in a sanitation scheme wherein they can function as privies. Preferably, more than one would be used, say for example three, such that when one is in use, waste in the other two would be in various stages of anaerobic digestion where biogas, such as methane, useful for cooking, is generated and ultimately the waste could be used as fertilizer. Typically, a first container would be in use and after a period of time, a second container used and after a period of time, a third container used wherein the waste in the first container would be substantially anaerobically digested.

DIGESTER

In another embodiment of the invention, a container is used as a waste disposal unit, such as for decomposting trash under aerobic or anaerobic conditions. A container 30, say for example 10 feet by 10 feet by 60 feet high having a foor, side and top, is made by the comply method of modular construction. The bottom structure has stretch film wound on a very strong pipe panels with pressure blocks using enough layers to withstand the great pressure and toxic by-products. Here the carrier/barrier multiple film concept is used, such as by coating the film with a polymerizable resin and/or tough, strong films like nylon or polyfluorinated films like Tefzel/Teflon.

For the digester, an inner, grid-like wall 32 parallel to an outer wall 34 is used without stretch wrap. The pipes of the wall 32 are all interconnected for fluid flow communication and include an inlet 36. The wall 32 is perforated to allow air, water, pH buffers and selected nutrients and microorganisms to permeate into the trash under aerobic or anaerobic conditions. The leachate is pumped out of the bottom via valve 38 and methane gas passes through the perforations and is recovered at 40.

Figure 8:
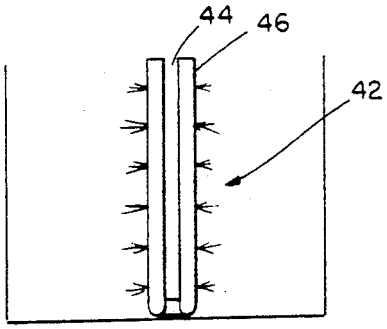
FIG. 8 is an alternative embodiment of a container of the invention used as a digester.

In a particularly preferred embodiment, referring to FIG. 8, in the center of the digester 30 is a pipe assembly 42 comprising two concentric pipes. An inner pipe 44 with no holes is to be used to pump out the accumulation of leachate/liquid/sludge that will collect at the bottom of the digester. An outer pipe 46 will be perforated for a dual function. First, to spray water, air, nutrients, etc. into the trash to help decompose it and secondly, to extract the methane gas generated by the digester.

GREENHOUSE PANEL/SOLAR HEATER

Figure 9:
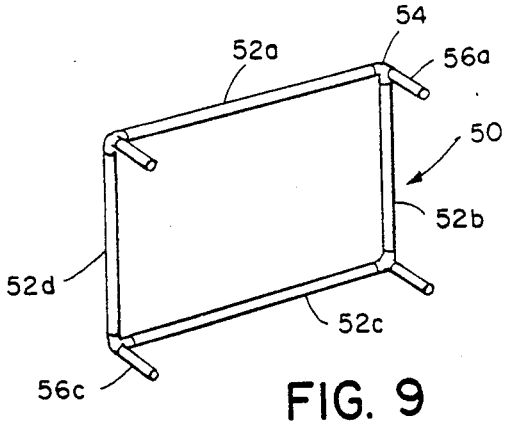
FIG. 9 is a schematic of a single pipe greenhouse panel.
Figure 7:
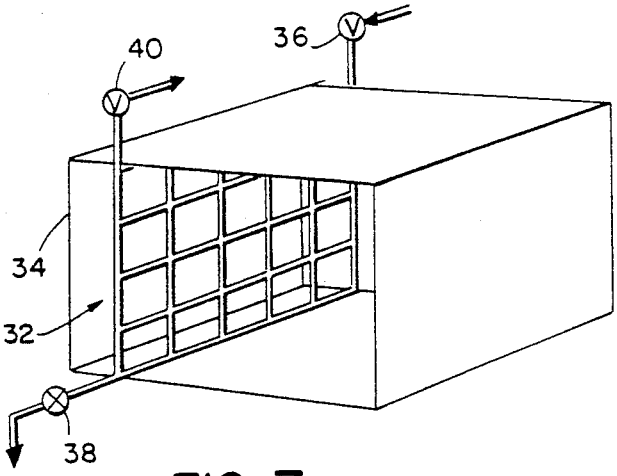
FIG. 7 is a schematic of a container used as a digester.

Referring to FIG. 9, a single pipe greenhouse-like panel 50 comprises the pipes 52*a*, 52*b*, 52*c* and 52*d* joined to form a square by three-way elbows 54 having perpendicularly extending pipe arms 56*a*, 56*b*, 56*c* and 56*d*. The entire panel is overwrapped with stretch wrap (not shown) and the extending arm(s) of the elbow can later be opened to provide for the introduction of fluids, typically water, into the panel. The fluid can circulate through the panel, such as by flowing into the opened arm 56*a* and being discharged from the arm 56*b*, the arms 56*c* and 56*d* being closed. Alternatively, the pipes 52*a* and 52*c* can be perforated, the pipe 52*a* perforated along its lower surface and pipe 52*b* perforated along its upper surface, so that water flowing into the panel through arm 56*a* can flow into and through the space defined by the stretch film. In this embodiment, the arms 56*c* and 56*d* may be opened or closed.

Figure 10:
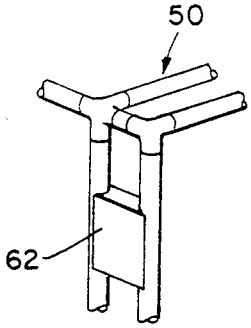
FIG. 10 is a schematic of a two-pipe greenhouse panel.

A two-panel assembly 60 is shown in FIG. 10 and the panels spaced apart by absorption blocks 62. The panels are temporarily held in place by tape or the like and then overwrapped with the stretch film (not shown).

As with the pipes of FIG. 9, the pipes of FIG. 10 may be perforated to allow for the flow of fluid through the pipes alone, through the spaced defined by the panels and/or both. With these embodiments, namely the ability of the water to flow through the space defined by the panels, or within the panels, the panels and/or assembly can function as a solar heater.

Figure 11:
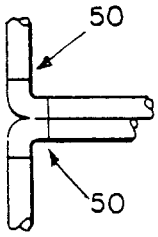
FIG. 11 is a schematic illustrating the panel received in T channel.

As shown in FIG. 11, the panels 50 may be used in combination with or without fluid flow communication therebetween, such as by tubular connectors.

Figure 12:
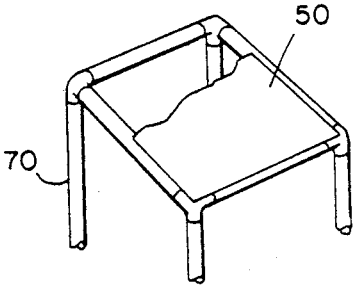
FIG. 12 is a schematic of transferring fluid from one panel to the next in a greenhouse assembly.

The panel assembly can be received in a frame 70, such as formed by angle irons, shown in FIG. 12, to form a greenhouse in whole or in part.

Further, the panels can be used in parallel or in series as a solar collector, such as on the roof of a house. It is an efficient collector of solar radiation to heat water.

HEAVY DUTY PANELS

Figure 13:
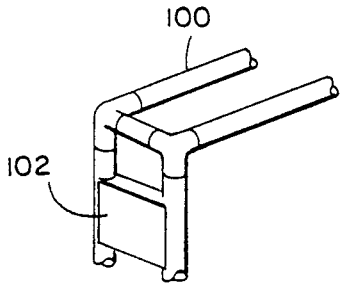
FIG. 13 is a perspective view of two pipes and an absorption block.

Referring to FIG. 13, two PVC pipes 100 are shown with an absorption block 102 therebetween. The absorption block includes two concave surfaces which mate with the convex surfaces of the associated pipes 100. The number of absorption blocks used in any particular panel will depend upon the ultimate use of the container and the particular density of the grid which defines a panel. That is, the number of pipes defining the grid. As with the preferred embodiment, the pipes are joined together using standard fittings preferably without adhesives.

Figure 14:
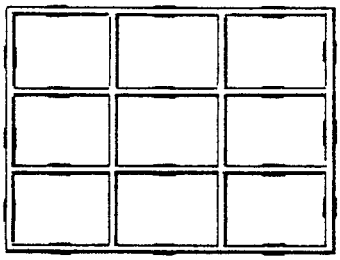
FIG. 14 is a schematic view of a panel with absorption blocks.

Referring to FIG. 14, heavy lines indicate the locations of absorption blocks 102 in a grid 104 of paired panels.

Figure 15:
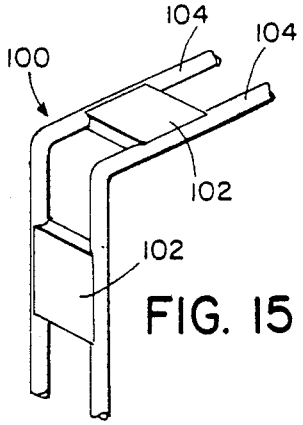
FIG. 15 is a perspective fragmentary view of two panels joined together without stretch film.

Referring to FIG. 15, joined grids 104 to form a heavy duty panel 106 are shown in fragmentary perspective view, the panel having been overwrapped with carrier film 62 to form a liner or container wall.

Figure 16:
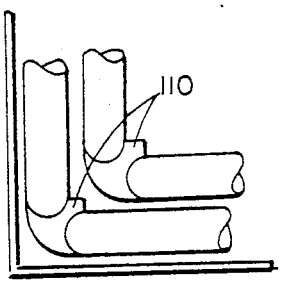
FIG. 16 is a plan framentary view of two wrapped panels joined at a 90° angle with a 90° absorption block.
Figure 17:
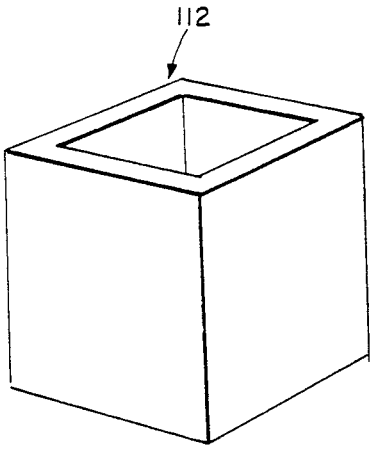
FIG. 17 is a schematic view of a liner formed with the panels.

To join the panels as sides and to the bottom and top to form a liner, 90° absorption blocks 110 are used as shown in FIG. 16 The panels are temporarily held in place, such as by tape, and then entire assembly overwrapped as shown in FIG. 17 to form a liner or container 112. This container may then be used per se for storage or as a liner as described for the preferred embodiment and thus may be overwrapped with barrier films, additional carrier film, additional reinforcing rods, etc.

In still a further embodiment of the invention, one technique to achieve maximum rigidity and strength in the pipe/pressure block combination is to use concave-shaped blocks as a splint. The splint covering joins to the pipe in a close fitting relationship and makes the junction of the fitting and the pipe stiffer and stronger. It prevents the pipe from slipping out of the fitting under pressure. The splint is secured to the fitting and pipe by spiral winding very strong tape with high tack. Glass fiber tape and especially high strength propylene tape with a tension application as used in stripping bundles is preferable.

Figure 18:
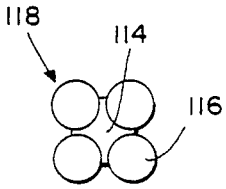
FIG. 18 is a schematic of a pipe cluster.

Referring to FIG. 18, a longitudinal splint 114 having four concave surfaces receives four longitudinal pipes 116, the splint 114 functioning as an absorption block and strengthening member. This results in a pipe cluster 118. This pipe cluster functions as a single structure for significant resistance to deformation and superior compression/tencil strength. The pipe cluster may be any number of separate pipes using a suitably shaped, extruded splint with the cavity accommodating each pipe separately but together the assembly is bound by the use of highstrength strapping, such as glass fiber or polypropylene under tension, or by applying adhesives or epoxy polymerizable resins to bond the pipe and the splint together or wrapping the cluster with bands of stretch wrap under tension.

SPECIAL STRUCTURAL EXTRUSIONS

The specially formed pipe can comprise an extruded pipe which may be round, rectangular or any desired shape, but obviously from a point of view of manufacturing, either round or rectangular is preferred. Received within the pipe is an extruded profile which can be in any geometric configuration as long as it functions in combination with the pipe to provide a pipe of increased strength. The extruded profiles can also be of the same cross sectional shape as the pipe and telescoped therein. The extruded profile has a thin coating of an adhesive on its surface to ensure engagement with the pipe. The adhesion can be a mechanical adhesion or a chemical adhesion, such as cross-linking by polymerization. One can pick from a variety of thermoplastic/-thermosetting resins to effect the bond. The pipe and extruded profile are customized to create the strongest possible fusion between the two or three concentric or telescoped elements. Two or three pipes can be telescoped within one another to form a two- or three-ply laminated composite pipe. The surfaces may be coated with a resin which is then polymerized.

Where similar pipes are used in the telescoped arrangement, the outer surface of the inner pipe can be ribbed, either in corrugated form or spirally, to enhance the bonding between the inner and outer pipes.

Where multiple pipes are received within an outer pipe, they may also be received in the outer pipe in side-by-side relationship rather than telescoped one within the other. Additionally, any of the special structural extensions may have projecting fins, ribs, projections or the like extending from their outer surface and thus function in a manner similar to a rebar (concrete reinforcing element).

Figure 19:
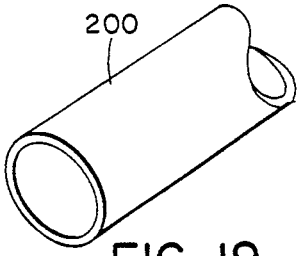
FIG. 19 is a schematic of a tubular extruded pipe.

FIG. 19 shows a circular pipe 200.

Figure 20:
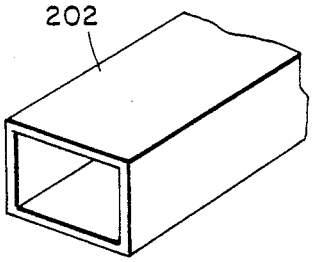
FIG. 20 is a schematic of an extruded rectangular pipe.

FIG. 20 shows a rectangular pipe 202.

Figure 21:
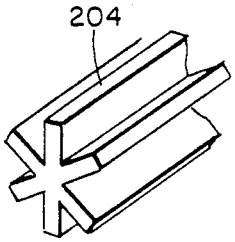
FIG. 21 is a schematic of an extruded profile in the form of spokes.

FIG. 21 shows an extruded profile 204 in the form of a spoke.

Figure 22:
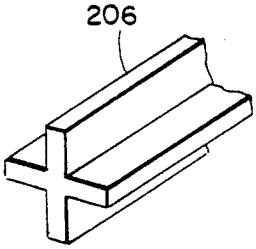
FIG. 22 is an extruded profile in the form of a maltese cross.

FIG. 22 shows an extruded profile 206 in the form of a maltese cross.

Figure 23:
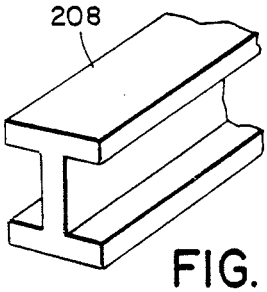
FIG. 23 is a schematic of an extruded profile in the form of an I-beam.

FIG. 23 shows an extruded profile 208 in the form of an I-beam.

Figure 24:
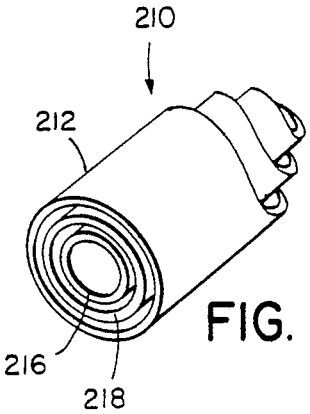
FIG. 24 is a schematic of an extruded profile having the same, but smaller, cross section of a pipe.

FIG. 24 shows a pipe 210 which comprises an outer pipe 212 and two extruded profiles which are in the form of tubular pipes 214 and 216 telescoped one within the other and all secured together by adhesives.

Figure 25:
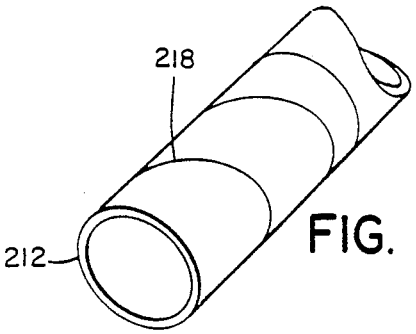
FIG. 25 is a schematic of an extruded profile having a spirally ribbed outer surface.

As shown in FIG. 25, if desired, any of the pipes may be ribbed on their outer surfaces, such as spirally, shown at 218 on the pipe 212

Figure 26:
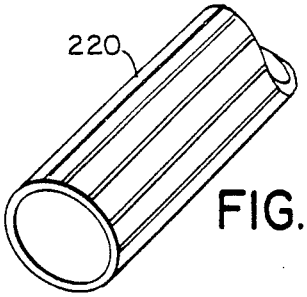
FIG. 26 is a schematic of an extruded profile having a longitudinal ribbed outer surface.

Referring to FIG. 26, any of the pipes may be ribbed longitudinally on their outer surface at 220.

Figure 27:
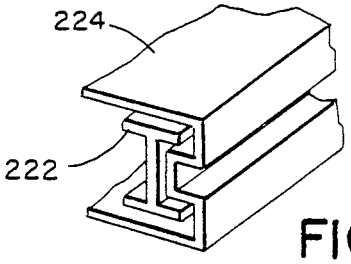
FIG. 27 is a schematic of an extruded profile telescoped within an extruded profile of similar cross section.

Referring to FIG. 27, extruded profiles may be telescoped one within the other and as shown an inner I-beam 222 is received within an outer I-beam 224.

Figure 28:
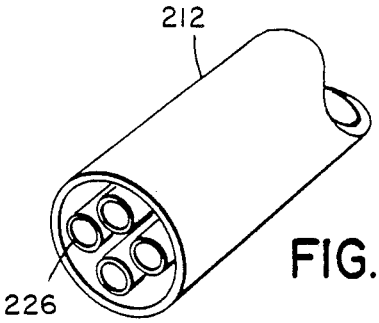
FIG. 28 is a schematic of a plurality of extruded profiles received in a pipe.

Referring to FIG. 28, a plurality of extruded profiles 226 in the form of pipes are received in the pipe 212.

Figure 29:
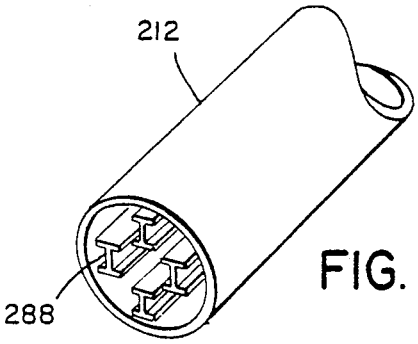
FIG. 29 is a schematic of a plurality of extruded profiles received in a pipe.

Referring to FIG. 29, a plurality of randomly orientated extruded profiles, such as I-beams 228, are received in the pipe 212.

For those embodiments where the pipes are telescoped, it is preferred that they have different coefficients of friction. The one with the higher coefficient of expansion should be the inner pipe. When heated, such as with dielectric heating, the inner pipe will expand slightly and contact the outer pipe with greater pressure to create a very strong combination. Of the various combinations of the special structural extrusions, the extruded profile can be laminated to the interior of pipe; there can be multiple pipes telescoped within the other and laminated one to the other; an extruded profile can be laminated to a previously laminated telescoped pipe; the laminated profiles may be laminated one within the other; and the profiles can be coextruded.

It is within the scope of the invention, although described with reference to PVC, it also includes chlorinated polyvinylchloride, polyvinylidene fluoride, high-impact polystyrene, acrylonitrile-butadiene-styrene, polypropylene, high density polyethylene, polycarbomates, which may or may not be glass or carbon fiber reinforced, and nylon.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A container which comprises:

a liner having longitudinal members compressively secured together by a first carrier film;

at least one water-impermeable barrier film overlying the liner;

a second carrier film overlying the barrier film to form a container; and at least some of the longitudinal members comprising specially extruded members, said specially extruded members comprising at least first and second members, one received within the other for the entire length thereof, the members joined together to function as an integral unit.

2. The container of claim 1 wherein the container is substantially rectangular in shape.

3. The container of claim 1 wherein the container is substantially circular in shape.

4. The container of claim 1 wherein the longitudinal members comprise tubular pipes and fittings.

5. The container of claim 1 which includes:

means to introduce a liquid into the container;

means to remove the liquid from the container;

a perforated pipe received in the container;

means to introduce fluids into the perforated pipe and into the container, said fluids comprising nutrients to aid in the aerobic or anaerobic digestion of waste; and a non-perforated pipe spaced apart from the bottom of the container and adapted to carry fluids from the bottom of the container.

6. The container of claim 1 wherein at least some of the members of the container are perforated pipe and the carrier defines an enclosed space and which includes:

means to flow fluid into and out of the defined space whereby it may function as a solar panel.

7. The container of claim 1 which includes:

a pair panels, the panels joined in spaced apart relationship from one another to form an assembly; and means to introduce fluid into the assembly.

8. The container of claim 1 which includes:

a pair of walls formed in the shape of grid-like panels, the panels joined together in paired relationship with absorption blocks therebetween to define a heavy duty panel.

9. The container of claim 1 wherein the first member comprises an outer pipe and the second member is dimensionally similar pipe(s) telescoped and adhered therein.

10. The container of claim 9 wherein the outer pipe is circular in cross section.

11. The container of claim 1 wherein the second member is in a spoke-like configuration.

12. The container of claim 9 wherein the inner member is in the form of an I-beam having convex, flanged surfaces which mate with the inner concave surface of the pipe.

13. The container of claim 9 wherein the pipe is substantially rectangular in shape.

14. The container of claim 1 wherein the outer member has on its outer surface strengthening members.

15. The container of claim 14 wherein said strengthening members are longitudinal extending ribs.

16. The container of claim 14 wherein said strengthening members comprise a helical rib.

17. The container of claim 9 wherein the second member comprises a plurality of members received in random orientation within the first member.

* * * * *